US010577872B2

(12) United States Patent
Lee et al.

(10) Patent No.: US 10,577,872 B2
(45) Date of Patent: Mar. 3, 2020

(54) CURBED LINKS FOR WIRING CONDUIT

(71) Applicant: Halliburton Energy Services, Inc., Houston, TX (US)

(72) Inventors: Shao Hwa Lee, Singapore (SG); Hong Jin Lau, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 99 days.

(21) Appl. No.: 15/737,633

(22) PCT Filed: Jul. 28, 2015

(86) PCT No.: PCT/US2015/042365
§ 371 (c)(1),
(2) Date: Dec. 18, 2017

(87) PCT Pub. No.: WO2017/019027
PCT Pub. Date: Feb. 2, 2017

(65) Prior Publication Data

US 2018/0155990 A1 Jun. 7, 2018

(51) Int. Cl.
*F16L 3/015* (2006.01)
*E21B 17/00* (2006.01)
(Continued)

(52) U.S. Cl.
CPC ..... *E21B 17/003* (2013.01); *E21B 17/05* (2013.01); *E21B 17/22* (2013.01); *E21B 23/00* (2013.01)

(58) Field of Classification Search
CPC .... F16G 13/16; H02G 11/006; H02G 3/0475; F16L 3/015; F16L 3/01; Y10T 137/8807; B66C 13/12
See application file for complete search history.

(56) References Cited

U.S. PATENT DOCUMENTS 3,281,080 A 10/1966 Hogg
3,721,260 A 3/1973 Stahmer
(Continued)

FOREIGN PATENT DOCUMENTS

| | | |
|---|---|---|
| EP | 1011180 | 6/2000 |
| JP | 09/298814 | 11/1997 |
| WO | 2015/012805 | 1/2015 |

OTHER PUBLICATIONS

Foster, Jerry, Rebecca Ann McConnell, and Darrel W. Moore. "New Downhole Electromechanical Service Tool Advancements Provide Increased Integrity in HP/HT Environments." SPE/ICoTA Coiled Tubing Conference & Exhibition. Society of Petroleum Engineers, 2006; 2 pages.
(Continued)

*Primary Examiner* — Kipp C Wallace
(74) *Attorney, Agent, or Firm* — Baker Botts L.L.P.

(57) ABSTRACT

A downhole tool is disclosed. The downhole tool may include an actuator having a housing, a shaft extending through at least a portion of the housing, and a nut movably disposed on the shaft. Further, the downhole tool may include a wiring conduit disposed in a helix shape around the shaft, and extending between the nut and a fixed position relative to the shaft. The wiring conduit may include a plurality of curved links. Each of the plurality of curved links may include a first hinge and a second hinge, the first hinge of a first curved link pivotably coupled to the second hinge of a second curved link. The downhole tool may also include a wire routed through the wiring conduit.

19 Claims, 8 Drawing Sheets

(51) Int. Cl.

| | |
|---|---|
| ***E21B 23/00*** | (2006.01) |
| ***E21B 17/05*** | (2006.01) |
| ***E21B 17/22*** | (2006.01) |

(56) References Cited

U.S. PATENT DOCUMENTS

| | | | | |
|---|---|---|---|---|
| 3,942,554 | A | 3/1976 | Werner et al. | |
| 4,007,797 | A * | 2/1977 | Jeter | E21B 4/00 173/149 |
| 4,391,297 | A | 7/1983 | Knight | |
| 4,807,432 | A * | 2/1989 | Mauri | F16G 13/16 248/49 |
| 6,060,662 | A | 5/2000 | Rafie et al. | |
| 6,100,609 | A | 8/2000 | Weber | |
| 6,364,023 | B1 | 4/2002 | Hiron et al. | |
| 6,825,656 | B2 | 11/2004 | Hanisch | |
| 7,341,101 | B1 * | 3/2008 | Moretz | E21B 33/072 166/241.5 |
| 7,752,932 | B2 | 7/2010 | Chen et al. | |
| 8,387,763 | B2 | 3/2013 | Skowronski et al. | |
| 8,661,744 | B2 | 3/2014 | Keller | |
| 8,701,897 | B2 | 4/2014 | Bailey et al. | |
| 8,714,039 | B2 | 5/2014 | Wu | |
| 2004/0065444 | A1 | 4/2004 | Smith et al. | |
| 2005/0045339 | A1 | 3/2005 | Hall et al. | |
| 2006/0258229 | A1 * | 11/2006 | Harada | B25J 19/0025 439/736 |
| 2007/0158092 | A1 * | 7/2007 | Ogawa | B60J 5/06 174/19 |
| 2014/0238740 | A1 * | 8/2014 | Inoue | H02G 11/006 174/72 A |
| 2015/0086274 | A1 * | 3/2015 | Schwartz | F16L 1/203 405/168.3 |

OTHER PUBLICATIONS

International Search Report and Written Opinion received for PCT Patent Application No. PCT/US2015/042365, dated Apr. 20, 2016; 9 pages.

* cited by examiner

CURBED LINKS FOR WIRING CONDUIT

RELATED APPLICATIONS

This application is a U.S. National Stage Application of International Application No. PCT/US2015/042365 filed Jul. 28, 2015, which designates the United States, and which is incorporated herein by reference in its entirety.

TECHNICAL FIELD

The present disclosure relates generally to downhole tools and, more particularly, to a wiring conduit for a linear actuator in tool string.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation.

While performing subterranean operations, it is often desirable to suspend downhole tools in the wellbore from a rope, wire, line, tube, or cable. Downhole tools may be utilized to monitor or measure various characteristics of the subterranean formation. Some downhole tools may include features that move relative to one another. Such features may be coupled to a linear actuator, which, when activated, may move one feature relative to another feature. Such moving features may be communicatively coupled together by wiring that allows the moving features to communicate with each other. Moreover, the wiring may be routed between such features by a wiring conduit.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

According to the present disclosure, a downhole tool (e.g., a wireline tool or a downhole drilling tool) may include a linear actuator that may operate to move one feature of the downhole tool relative to another feature of the downhole tool. The downhole tool may also include wiring that communicatively couples such features together. The wiring may be routed from a first feature of the downhole tool, to a second feature of the downhole tool, through a retractable wiring conduit.

The wiring conduit may include a series of links. Each link may include a hinge at a first end and a hinge at a second end, and may couple to other links at the respective hinges. The hinges may allow the links to pivot relative to one another as the wiring conduit is expanded and retracted. Accordingly, the series of links may expand and retract as the two features of the downhole tool are moved, by the linear actuator, apart and back toward each other. Thus, the wiring conduit may allow the wiring to be extended and retracted in predictable manner across a range of distances as the features of the downhole tool move with respect to each other. Moreover, the wiring conduit may allow the wiring to be stored in a volume having a length that is significantly smaller in a retracted condition than a length in an extended condition.

There are numerous ways in which a series of links may be implemented to provide a wiring conduit in a downhole tool. Thus, embodiments of the present disclosure and its advantages are best understood by referring to FIGS. 1 through 8B, where like numbers are used to indicate like and corresponding parts.

Figure 1:
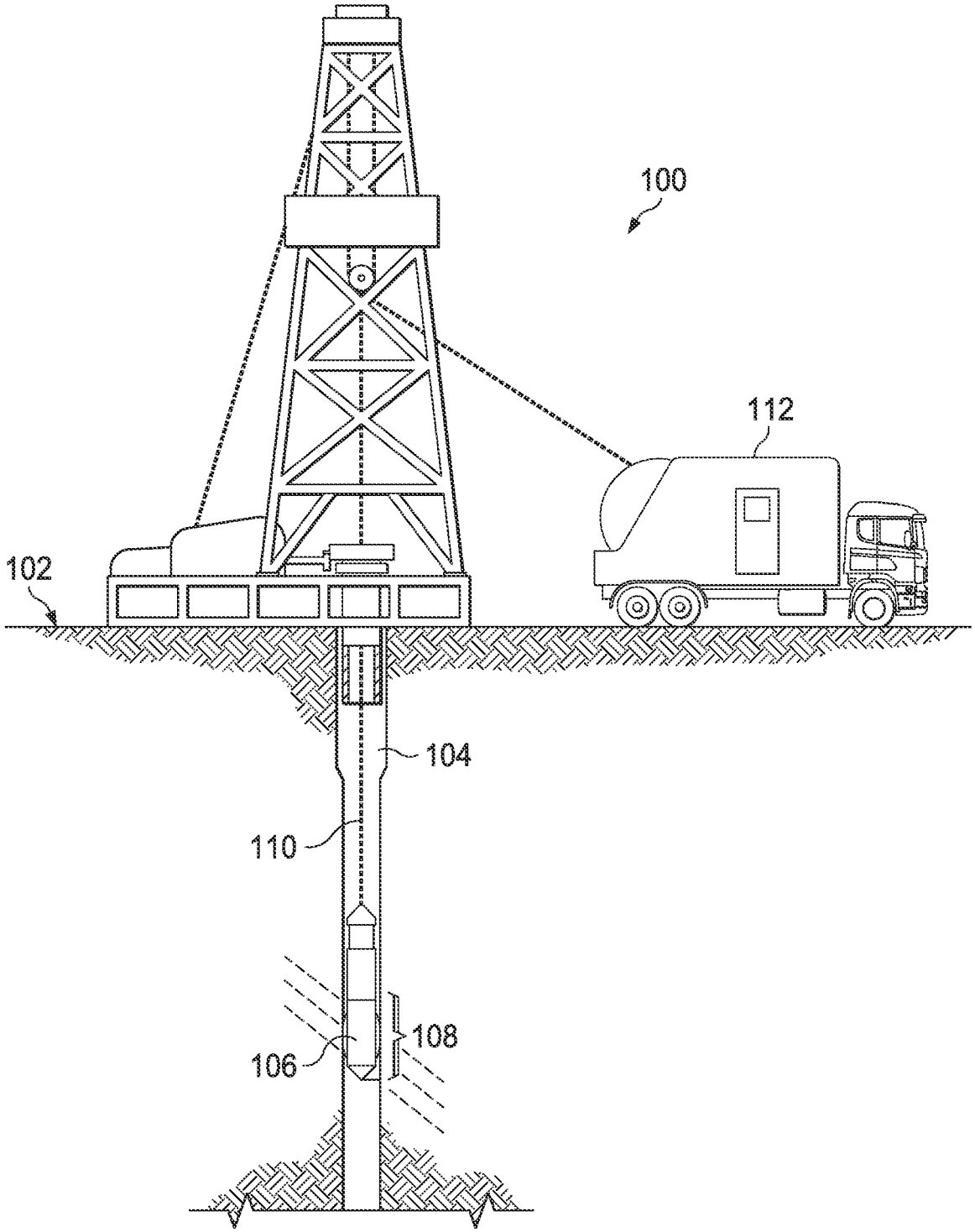
FIG. 1 illustrates an elevation view of an example embodiment of a subterranean operations system used in an illustrative wellbore environment.

FIG. 1 illustrates an elevation view of an example embodiment of a subterranean operations system used in an illustrative wellbore environment. Modern hydrocarbon drilling and production operations may use conveyances such as ropes, wires, lines, tubes, or cables to suspend a downhole tool in a wellbore. Although FIG. 1 shows land-based equipment, downhole tools incorporating teachings of the present disclosure may be satisfactorily used with equipment located on offshore platforms, drill ships, semi-submersibles, and drilling barges (not expressly shown). Additionally, while wellbore 104 is shown as being a generally vertical wellbore, wellbore 104 may be any orientation including generally horizontal, multilateral, or directional.

Subterranean operations system 100 may include wellbore 104. Uphole may be used to refer to a portion of wellbore 104 that is closer to well surface 102 and downhole may be used to refer to a portion of wellbore 104 that is further from well surface 102. Subterranean operations may be conducted using wireline system 106 including one or more downhole tools 108 that may be suspended in wellbore 104 from line 110. Line 110 may be any type of conveyance, such as a rope, cable, line, tube, or wire which may be suspended in wellbore 104. In some embodiments, line 110 may be a single strand of conveyance. In other embodiments, line 110 may be a compound or composite line made of multiple strands of conveyance woven or braided together. Line 110 may be compound when a stronger line is required to support downhole tool 108 or when multiple strands are required to carry different types of power, signals, and/or data.

Line 110 may include one or more conductors for transporting power, data, and/or signals to wireline system 106 and/or telemetry data from downhole tool 108 to logging facility 112. Alternatively, line 110 may lack a conductor, as is often the case using slickline or coiled tubing, and wireline system 106 may include a control unit that includes memory, one or more batteries, and/or one or more processors for performing operations to control downhole tool 108 and for storing measurements.

One or more downhole tools 108 may be utilized as part of wireline system 106 to monitor or measure various characteristics of wellbore 104 or subterranean formation. As described in further detail below with reference to FIG. 2A, downhole tools, such as downhole tool 108, may include a linear actuator configured to move different features of the downhole tool relative to one another during operation. Although linear actuators are described herein as being incorporated within a wireline system (e.g., wireline system 106), linear actuators described herein may be configured to move different features of any suitable downhole tool (e.g., a wireline tool or a downhole drilling tool) implemented, for example, in either a wireline system or a drill string.

Figure 2A:
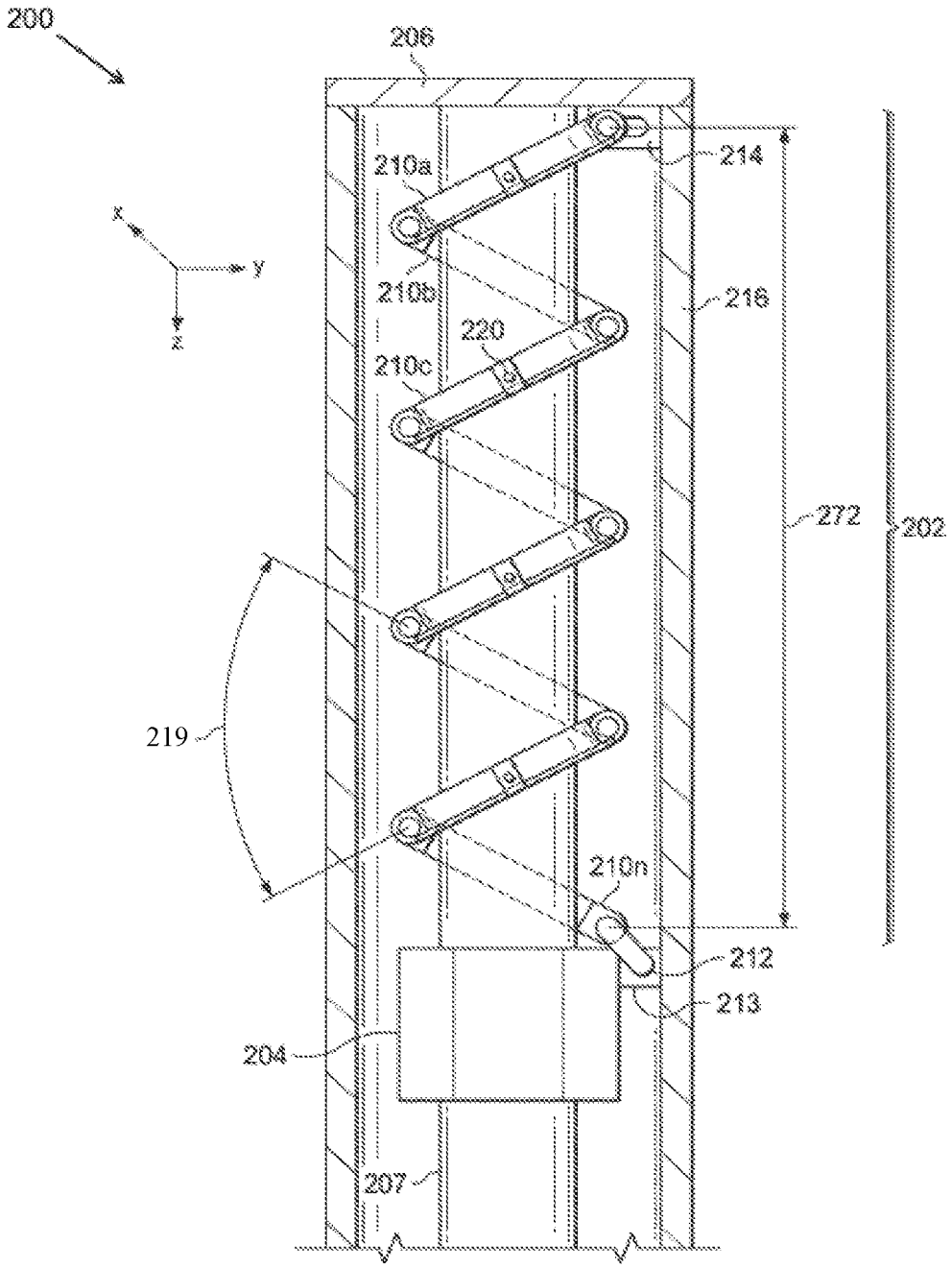
FIG. 2A illustrates a side view of a linear actuator with a wiring conduit in an extended condition.
Figure 2B:
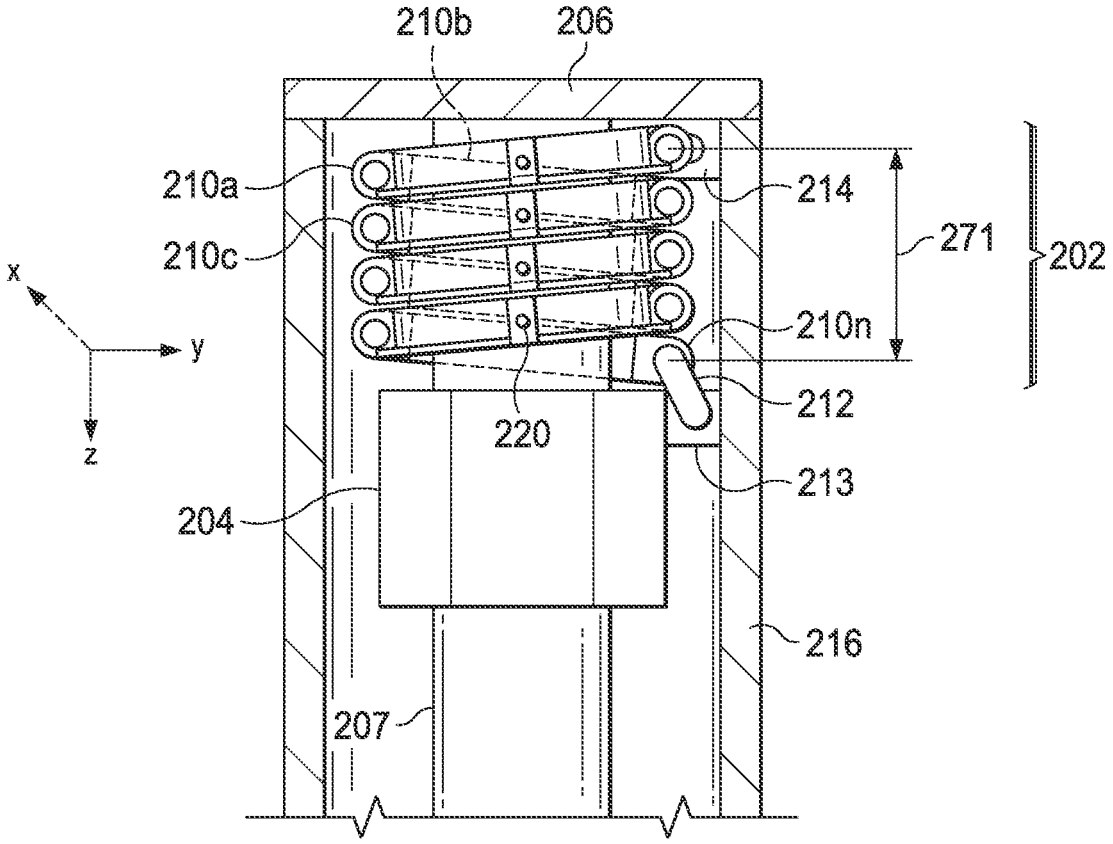
FIG. 2B illustrates a side view of a linear actuator with a wiring conduit in a retracted condition.

FIG. 2A illustrates a side view of a linear actuator with a wiring conduit in an extended condition. FIG. 2B illustrates a side view of a linear actuator with a wiring conduit in a retracted condition.

Linear actuator 200 may include nut 204, cap 206, and shaft 207. As shown in FIG. 2A, actuation of linear actuator 200 may move nut 204 away from cap 206. And, as shown in FIG. 2B, actuation of linear actuator 200 may move nut 204 toward cap 206. Nut 204 may be movably disposed on shaft 207. For example, shaft 207 may have a smooth surface, and nut 204 may slide along shaft 207 when linear actuator moves nut 204 toward or away from cap 206. As another example, shaft 207 may have a threaded surface. For such implementations, nut 204 may include threads configured to engage with the threaded surface of shaft 207. Accordingly, nut 204 may be moved toward or away from cap 206 based on the rotation of shaft 207.

Linear actuator 200 may also include housing 216. Components of the linear actuator 200 including, but not limited to, nut 204, cap 206, links 210, connector 212, and connector 214 may be positioned at least partially within the housing 216. Nut 204 may be movable relative to the housing 216 by the actuation of the linear actuator 200. As described in further detail below with reference to FIG. 4, individual links 210 may each include a wire guide that may interact with an inner wall of housing 216 to maintain alignment of links 210 within housing 216 as wiring conduit 202 is expanded and retracted.

Cap 206 may be coupled with the housing 216. Cap 206 may include features for connecting the housing 216 to other portions of a wireline system such as wireline system 106 depicted in FIG. 1. For example, the cap 206 may include a key operating assembly for operating valves through the wireline system 106. Additionally or alternatively, the cap 206 may include other components utilizing data transmission, power transmission, or both. Although the cap 206 is depicted in FIG. 2A as a component that attaches to an end of the housing 216, the cap 206 may be positioned anywhere along the length of the housing 216. Cap 206 may also be a component positioned partially or fully within the housing 216.

Linear actuator 200 may also include wiring conduit 202. Wiring conduit 202 may include individual links 210*a-n*. Wiring conduit 202 may serve as a guide for wires extending, for example, between nut 204 and cap 206. The routing of wires through each individual link 210 of wiring conduit 202 is described in further detail below with reference to FIG. 3. Referring again to FIG. 2A, wiring conduit 202 may include a first link 210*a* coupled at a first end to cap 206 via connector 214, such that the first end of first link 210*a* pivots about connector 214. As shown in FIG. 2A, link 210*a* may wrap around a front-facing side of shaft 207. First link 210*a* may also be coupled at a second end to a second link 210*b*, such that first link 210*a* and second link 210*b* pivot relative to each other. As shown in FIG. 2A, second link 210*b* may wrap around a rear-facing side of shaft 207 and couple to another link in the series of links 210 forming wiring conduit 202. The individual links may be coupled to one another in series, and in a manner that allows the individual links to pivot relative to one another. Further, wiring conduit 202 may end with link 210*n*, which may be coupled to nut 204 via connector 212 and nut extension 213 such that link 210*n* pivots about connector 212. Accordingly, the series of links 210 may allow wiring conduit 202 to expand or contract as nut 204 is moved relative to cap 206. Although FIGS. 2A and 2B illustrate wiring conduit 202 extending between nut 204 and cap 206, wiring conduit 202 may be coupled to extend between nut 204 and any other feature that has a fixed position relative to shaft 207 and/or housing 216, or between any two features that may move with respect to each other along shaft 207.

As shown in FIG. 2A, link 210*a* and link 210*b* may pivot with respect to each other (at a first end of link 210*b*) to an open position when wiring conduit 202 is placed in an extended condition between nut 204 and cap 206. Likewise, link 210*b* and link 210*c* may pivot with respect to each other (at a second end of link 210*b*) to an open position when wiring conduit 202 is placed in an extended condition between nut 204 and cap 206. The coupling of link 210*b* between links 210*a* and 210*c* remains when wiring conduit 202 is placed in a retracted condition between nut 204 and cap 206. Thus, when wiring conduit 202 is placed in a retracted condition as shown in FIG. 2B, links 210*a* and 210*b* may pivot with respect to each other (at the first end of link 210*b*) to a closed position, and links 210*b* and 210*c* may pivot with respect to each other (at the second end of link 210*b*) to a closed position.

The pivoting of links 210 allows wiring conduit 202 to dynamically route one or more wires across varying distances as wiring conduit 202 is extended and retracted. For example, wiring conduit 202 may route one or more wires across a first distance 271 when wiring conduit 202 is in a retracted condition as shown in FIG. 2B. Wiring conduit 202 may also route one or more wires across a second distance 272 when wiring conduit 202 is in an extended condition as shown in FIG. 2A. In some embodiments, the ratio of the second distance 272 to the first distance 271 may be, for example, 6:1, 10:1, or greater. For example, in some embodiments, wiring conduit 202 may span a first distance 271 of two inches when retracted, and may span a second distance 272 of twenty inches when extended. Although wiring conduit 202 is illustrated in FIGS. 2A and 2B as having "n" number of links 210, wiring conduit 202 may include any suitable number of links 210 to enable wiring conduit 202 to expand and retract across any desired distances.

In some embodiments, individual links 210 of wiring conduit 202 may be configured to couple together with a maximum pivot angle 219. For example, the hinges at which individual links 210 couple to one another may include a stopper that sets the maximum angle at which one link 210 may pivot relative to another link 210. An example of such a stopper is described in further detail below with reference to FIG. 7. Links 210 may be configured with maximum pivot angle 219 corresponding to the diameter of shaft 207 and the lengths of links 210, such that links 210 do not physically touch shaft 207 when links 210 are fully opened to maximum pivot angle 219. Accordingly, maximum pivot angle 219 may prevent links 210 from interacting with and causing wear, for example, on a threaded surface of shaft 107.

Figure 3:
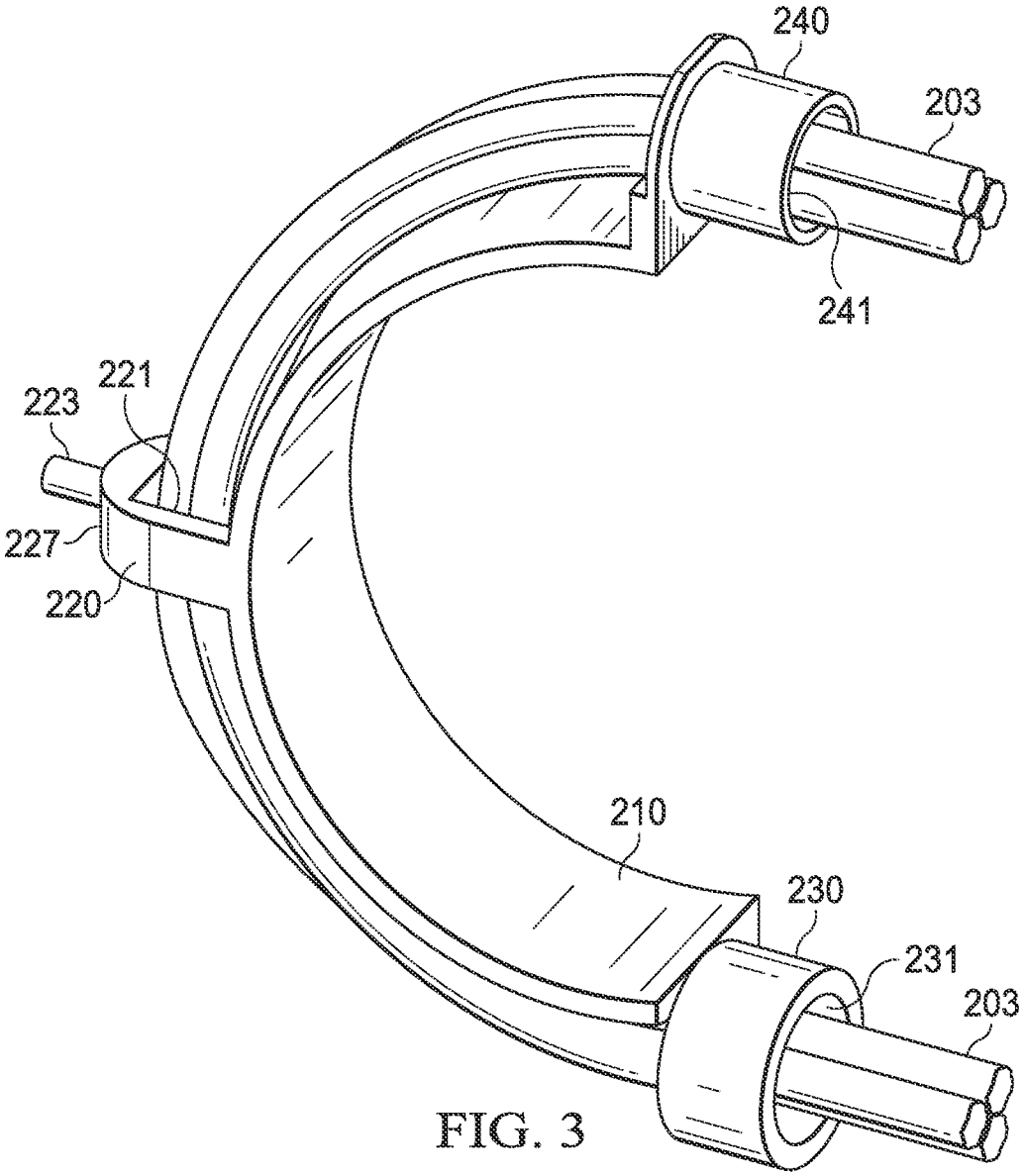
FIG. 3 illustrates a front perspective view of an example link.

FIG. 3 illustrates a front perspective view of an example link. Link 210 may include outer hinge 230 and inner hinge 240. In some embodiments, the inner hinge 240 of one instance of link 210 (e.g., link 210*b* in FIG. 2A) may couple to the outer hinge 230 of another instance of link 210 (e.g., link 210*c* in FIG. 2A). For example, outer hinge 230 may include channel 231, and the diameter of channel 231 may be slightly larger than the outer diameter of inner hinge 240. Accordingly, channel 231 of one instance of link 210 (e.g., link 210*c* in FIG. 2A) may receive inner hinge 240 of another instance of link 210 (e.g., link 210*b* in FIG. 2A), such that inner hinge 240 fits tightly within channel 231.

Inner hinge 240 may also include a channel. For example, inner hinge 240 may include channel 241. Link 210 may also include wire guide 220, which may include channel 221. In some embodiments, wire guide 220 may be located at the apex of the curved link. Further, as shown in FIG. 3, wiring 203 may be routed through channel 231 of outer hinge 230, through channel 221 of wire guide 220, and through channel 241 of inner hinge 240. Accordingly, as described above with reference to FIG. 2A, a series of links 210 may form a wiring conduit (e.g., wiring conduit 202) that may guide wiring 203 in a predictable manner as wiring conduit 202 is expanded and retracted in response to the actuation of linear actuator 200.

Moreover, as shown in FIG. 3, each link 210 may have a curved C shape. Due to the curved C-shape of each link 210, a wiring conduit (e.g., wiring conduit 202) formed by a series of links 210 may form a helix shape when the wiring conduit is in an extended condition (as shown in FIG. 2A) or in a retracted condition (as shown in FIG. 2B). Accordingly, wiring 203 may be guided across varying distances along a continuously curved path without an acute bend at any point along the path. Thus, the stress on wiring 203 as wiring conduit 202 is extended and retracted may be minimized.

In some embodiments, certain links 210 of wiring conduit 202 may pivot with respect to each other before other links 210 pivot with respect to each other, as wiring conduit 202 transitions from a retracted condition (as shown in FIG. 2B) to an extended condition (as shown in FIG. 2A). For example, as wiring conduit 202 transitions from a retracted condition to an extended condition, links 210*a* and 210*b* may pivot with respect to each other from a closed position to an open position before links 210*b* and 210*c* pivot with respect to each other from a closed position to an open position. Likewise, certain links 210 may pivot with respect to each other before other links 210 pivot with respect to each other, as wiring conduit 202 transitions from an extended condition to a closed condition. Accordingly, wiring conduit 202 may at times form a helix shape with a varying diameter and a varying pitch between the respective turns of wiring conduit 202. But regardless of any variation in the diameter or the pitch of the helix shape, wiring conduit 202 may maintain a continuously curved path, without an acute bend at any point along the path, during transitions of wiring conduit between extended and retracted conditions. Thus, as described directly above, the stress on wiring 203 as wiring conduit 202 is extended and refracted may be minimized.

Figure 4:
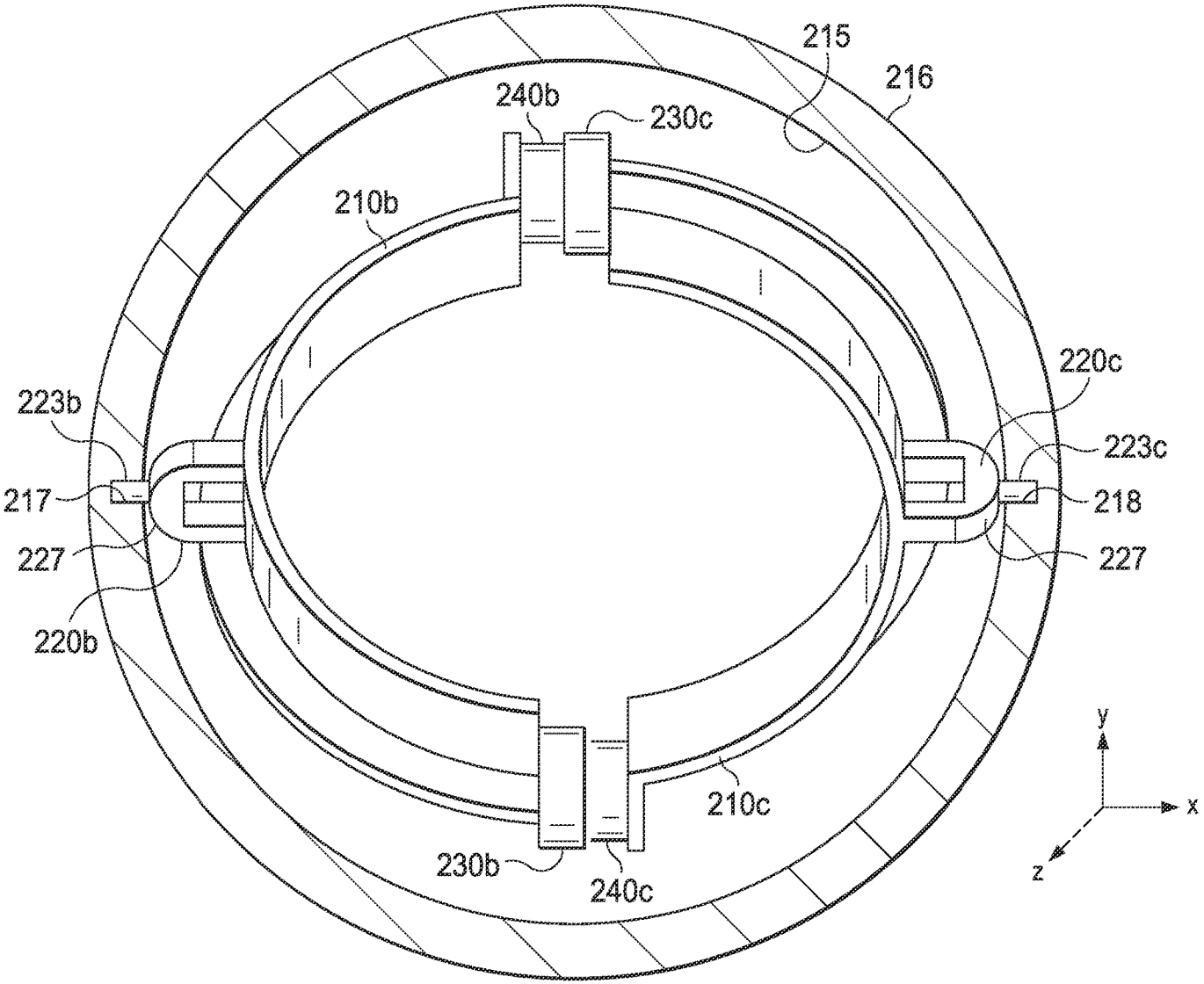
FIG. 4 illustrates a top view of two example links contained within a housing.

FIG. 4 illustrates a top view of two example links contained within a housing. For example, link 210*b* and link 210*c* may be contained within housing 216. Link 210*b* may include outer hinge 230*b*, inner hinge 240*b*, and wire guide 220*b*. Link 210*c* may include outer hinge 230*c*, inner hinge 240*c*, and wire guide 220*c*. As shown in FIG. 4, link 210*b* and link 210*c* may pivot with respect to each other to an open position. For example, inner hinge 240*b* of link 210*b* may be coupled to outer hinge 230*c* of link 210*c*, with link 210*c* pivoting downward from outer hinge 230*c*, and link 210*b* pivoting upward from inner hinge 240*b*.

When links 210*b* and 210*c* pivot from a closed position to an open position, the distance between the respective ends of each line along the direction of the y-axis may decrease. For example, as shown in FIG. 4, when links 210*b* and 210*c* pivot with respect to each other to an open position, the distance between the respective ends of each link in the direction of the y-axis may be less than the inner diameter of housing 216. But, the combined diameter of two coupled links, such as link 210*b* and link 210*c*, in the direction of the x-axis, may remain constant as links 210*b* and 210*c* pivot between closed and open positions.

In some embodiments, the combined diameter of two coupled links, such as link 210*b* and 210*c*, in the direction of the x-axis, may be approximately equal to an inner diameter of housing 216. For example, as shown in FIG. 4, the distance from outer tip 227 of wire guide 220*b* to outer tip 227 of wire guide 220*c*, in the direction of the x-axis, may be approximately equal to an inner diameter (e.g., the diameter of inner wall 215) of housing 216. Accordingly, wire guide 220*b* of link 210*b* may engage with and slide along inner wall 215, and wire guide 220*c* of link 210*c* may engage with and slide along an opposing side of inner wall 215, as wiring conduit 202 is extended and retracted within housing 216. Thus, the fit of the links (e.g., links 210*b* and 210*c*) of wiring conduit 202 within housing 216 may maintain the alignment of the links with each other, as the wiring conduit formed by the links is extended and retracted in the direction of the z-axis.

In some embodiments, individual links 210 may include an alignment pin 223 to further support the alignment of links 210 within housing 216. In such embodiments, alignment pins 223 of links 210 may engage with grooves in housing 216. For example, housing 216 may include groove 217, which may extend in the direction of the z-axis along inner wall 215 of housing 216. Housing 216 may also include groove 218. Groove 218 may be located at a position along inner wall 215 opposite of the position on inner wall of groove 217. And similar to groove 217, groove 218 may extend in the direction of the z-axis along inner wall 215 of housing 216. As shown in FIG. 4, alignment pin 223*b* of link 210*b* may engage with groove 217. Likewise, alignment pin 223*c* of link 210*c* may engage with groove 218. Accordingly, as wiring conduit is extended and contracted within housing 216, groove 217 and groove 218 may support the alignment of links 210*b* and 210*c* in the direction of the x-axis and y-axis as links 210*b* and 210*c* pivot with respect to each other and/or move in a direction of the z-axis.

Although FIG. 4 illustrates housing 216 as having a generally circular cross section, housing 216 may be formed by any suitable shape. For example, housing 216 may be formed by a cylinder having a generally circular cross section, by tubing having an oval cross section, or by tubing having a polygonal cross-section. In embodiments in which housing 216 has a non-circular cross section, the width of housing 216 in the direction of the y-axis may be larger or smaller than the width of housing 216 in the direction of the x-axis. Moreover, in some embodiments, including embodiments where links 210 (e.g., links 210*b* and 210*c*) include alignment pins 223 (e.g., alignment pins 223*b* and 223*c*), housing 216 may include a frame that may include grooves 217 and 218, but does not fully enclose links 210.

Figure 5:
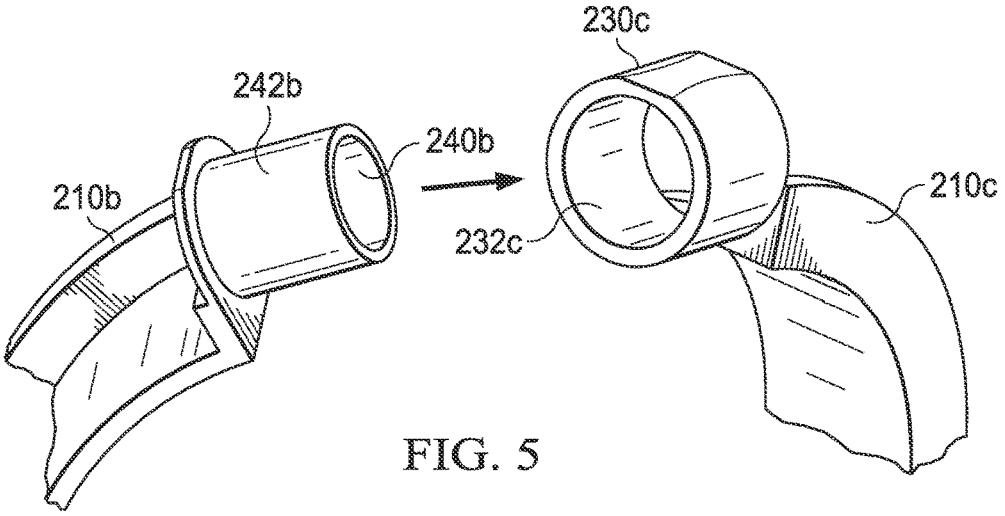
FIG. 5 illustrates an exploded view of example opposing hinges of two coupled links.

FIG. 5 illustrates an exploded view of example opposing hinges of two coupled links. As described above with reference to FIG. 4, inner hinge 240*b* of link 210*b* may be configured to couple with outer hinge 230*c* of link 210*c*. As shown in FIG. 5, outer hinge 230*c* may include a cylindrical inner surface 232*c*, and inner hinge 240*b* may include a cylindrical outer surface 242*b*. The diameter of inner surface 232*c* of outer hinge 230*c* may be slightly larger than the diameter of outer surface 242*b* of inner hinge 240*b*. Accordingly, inner hinge 240*b* may fit tightly within outer hinge 230*c* when link 210*b* and link 210*c* are coupled together, while allowing inner hinge 240*b* to rotate within outer hinge 230*c* as links 210*b* and 210*c* pivot with respect to each other.

In some embodiments, inner surface 232*c* of outer hinge 230*c*, and outer surface 242*b* of inner hinge 240*b*, may be continuously smooth surfaces with no outward extending extrusions and no inward extending notches. Accordingly, outer hinge 230*c* and inner hinge 240*b* may be free of stress points that may wear at a disproportional rate compared to other points on the respective hinges, thereby extending the usable life of links 210*b* and 210*c*.

Links such as link 210*b* and link 210*c* may be referred to as being coupled together merely by the insertion of inner hinge 240*b* of link 210*b* into the outer hinge 240*c* of link 210*c*. As described above with reference to FIG. 4, after links such as link 210*b* and link 210*c* are coupled together, the coupling and the alignment of the respective links may be maintained by their position within housing 216. And as described below with reference to FIG. 6, such links may also include further features to lock the coupled links together.

Figure 6:
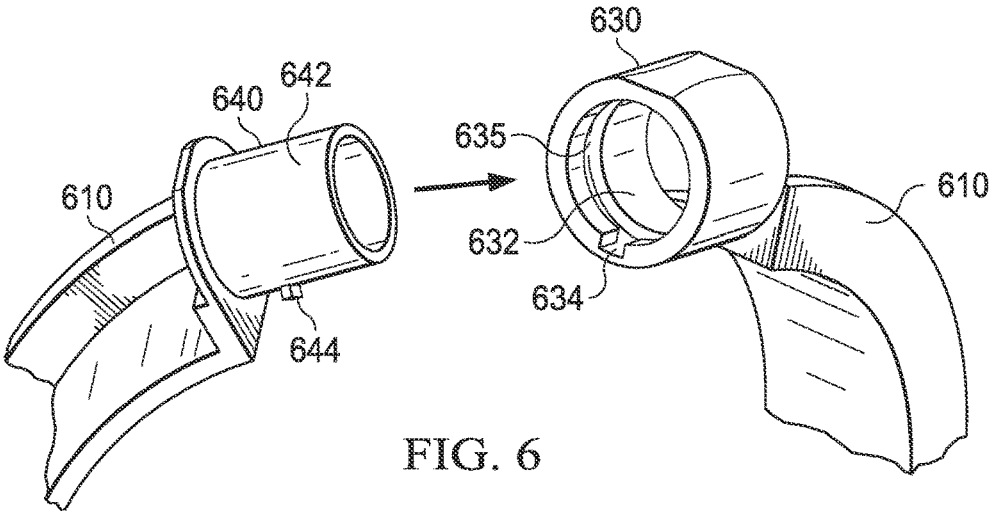
FIG. 6 illustrates an exploded view of example opposing hinges of two coupled links.

FIG. 6 illustrates an exploded view of example opposing hinges of two coupled links. A first instance of link 610 may include inner hinge 640. Similar to inner hinge 240*b* described above with reference to FIG. 5, inner hinge 640 may include a cylindrical and generally smooth outer surface 642. Inner hinge 640 may also include tab 644, which may engage with opposing features on outer hinge 630 on another instance of link 610. For example, similar to outer hinge 230*c* described above with reference to FIG. 5, outer hinge 630 may include a cylindrical and generally smooth inner surface 632. Outer hinge 630 may also include groove 635. Groove 635 may extend around the cylindrical inner surface 632 of outer hinge 630. Further, groove 635 may adjoin entry-groove 634, which may extend from groove 635 to an outer edge of outer hinge 630. Accordingly, tab 644 may combine with entry-groove 634 and groove 635 to form a tab-and-groove lock. The tab-and-groove lock may lock the respective instances of link 610 together after the links have been coupled to each other.

Figure 7:
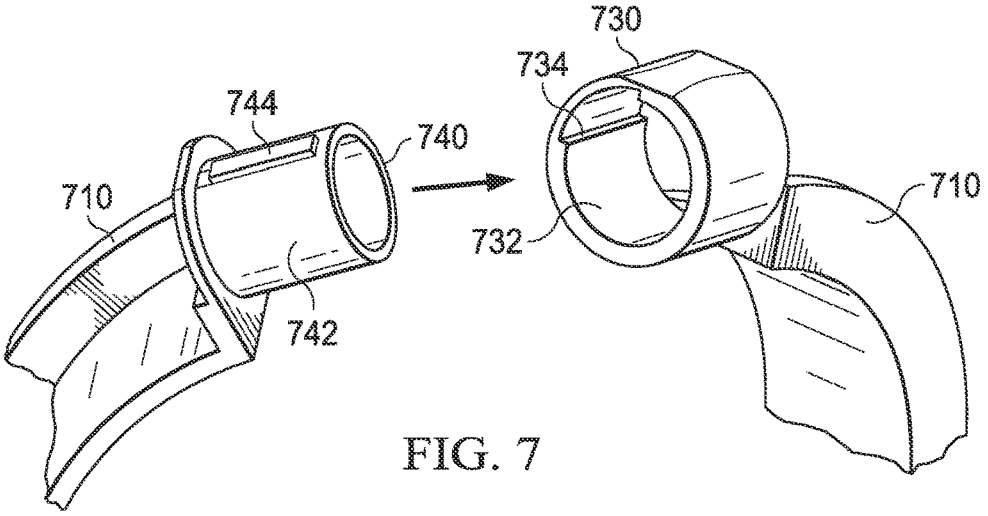
FIG. 7 illustrates an exploded view of example opposing hinges of two coupled links.

FIG. 7 illustrates an exploded view of example opposing hinges of two coupled links. A first instance of link 710 may include inner hinge 740. Similar to inner hinge 240*b* described above with reference to FIG. 5, inner hinge 740 may include a cylindrical and generally smooth outer surface 742. Inner hinge 640 may also include stopper 744. In some embodiments, stopper 744 may be formed by a tab that extends across a width of the cylindrical outer surface 742.

A second instance of link 710 may include outer hinge 730. Similar to outer hinge 230*c* described above with reference to FIG. 5, outer hinge 730 may include a cylindrical and generally smooth inner surface 732. Outer hinge 730 may also include ridge 734. In some embodiments, ridge 734 may extend across a width of the cylindrical inner surface 732 of outer hinge 730.

Inner hinge 740 of a first instance of link 710 may be inserted into outer hinge 730 of the second instance of link 710, and the respective links may pivot with respect to each other. Stopper 744 may then engage with ridge 734 to limit the maximum pivot angle at which the first instance of link 710 may pivot with respect to the second instance of link 710. For example, stopper 744 may engage with ridge 734 to limit the maximum pivot angle as illustrated by maximum pivot angle 219 in FIG. 2A. In some embodiments, stopper 744 may be located on inner hinge 744, and ridge 734 may be located on outer hinge 730 such that the maximum pivot angle is set to ninety degrees. In other embodiments, stopper 744 may be located on inner hinge 744, and ridge 734 may be located on outer hinge 730 such that the maximum pivot angle is set forty-five degrees or less, or one-hundred and thirty-five degrees or more.

Figure 8A:
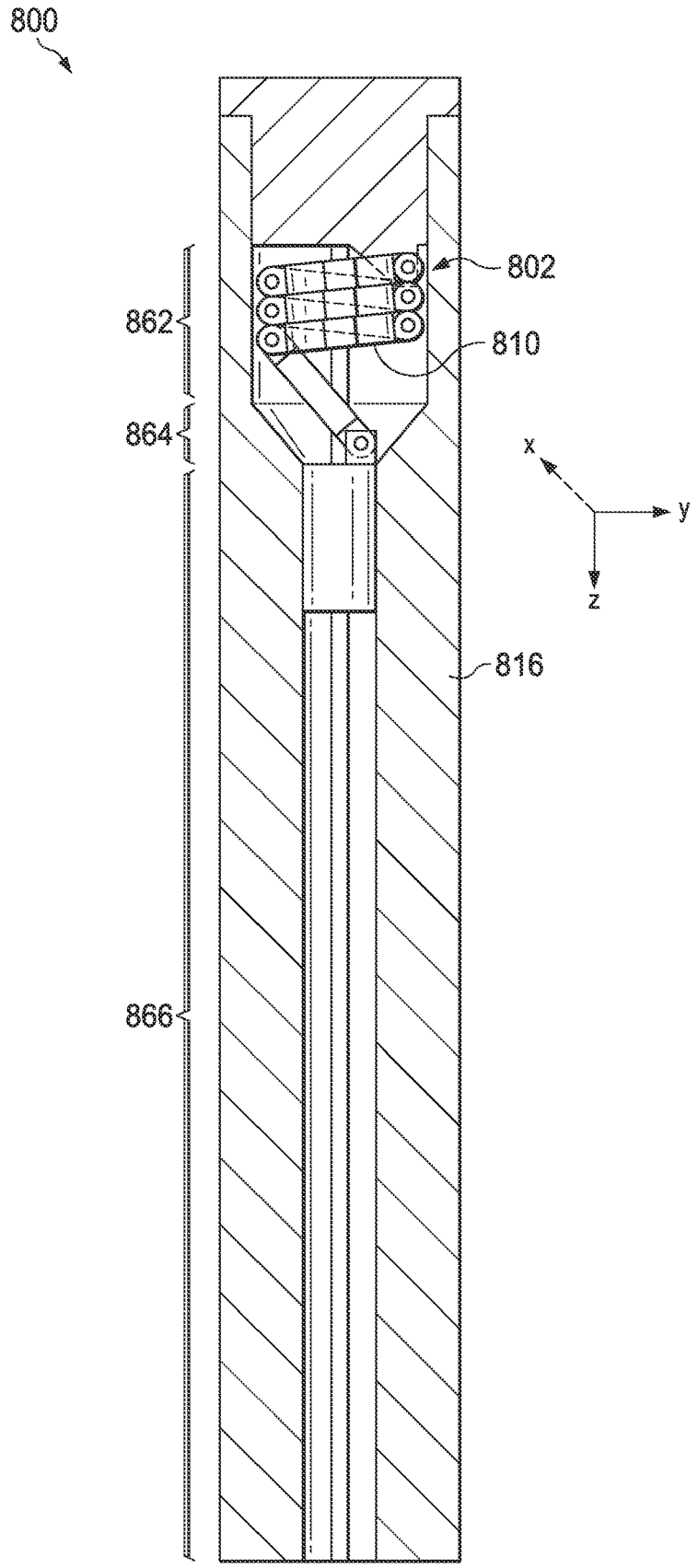
FIG. 8A illustrates a side view of a linear actuator with a wiring conduit in a retracted condition.

FIG. 8A illustrates an example of a linear actuator with a wiring conduit in a retracted condition. Linear actuator 800 may include housing 816 with a non-uniform bore size. Housing 816 may have first section 862, second section 864, and third section 866. First section 862 may have a bore sized to accommodate links 810 of the wiring conduit 802 in the retracted condition. For example, links 810 in the first section 862 may be pivoted to a closed position with respect to each other.

Figure 8B:
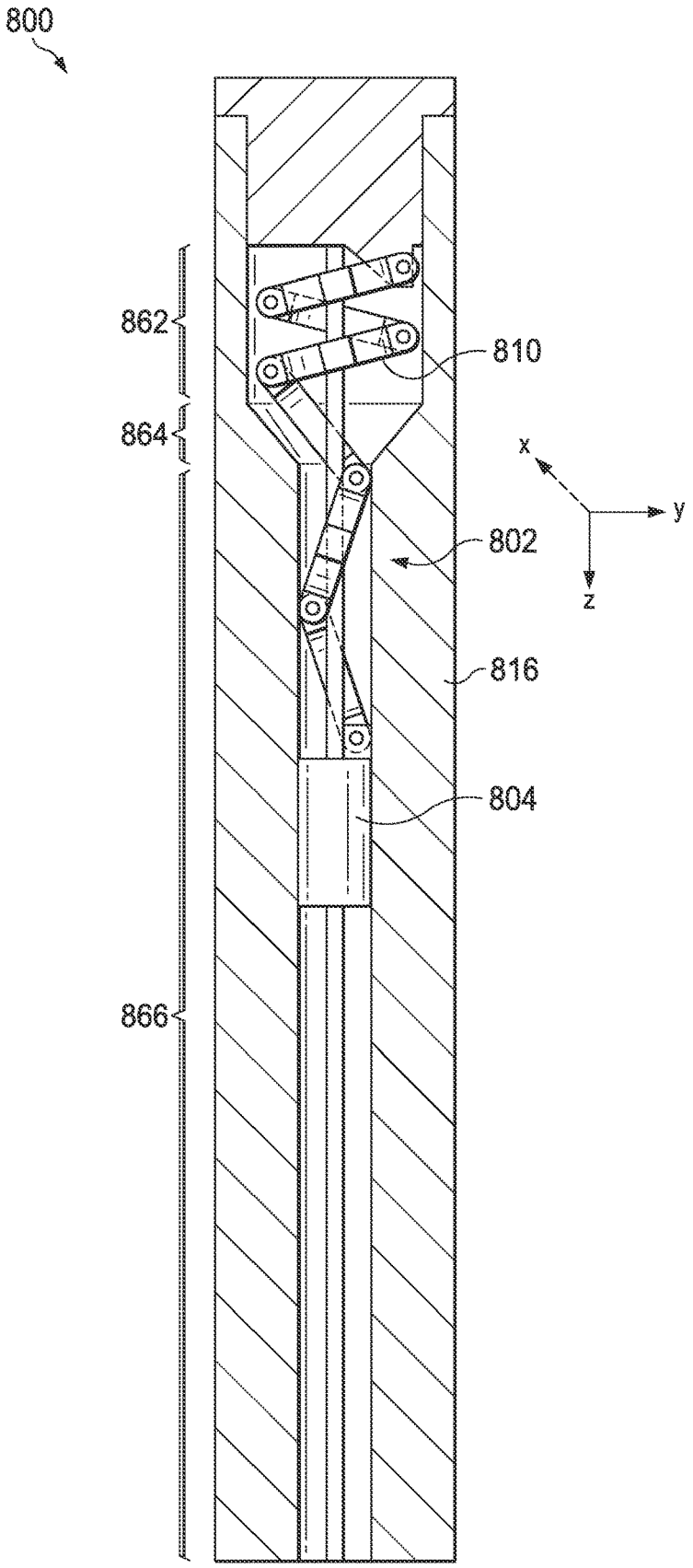
FIG. 8B illustrates a side view of a linear actuator with a wiring conduit in an intermediate condition.

FIG. 8B illustrates an example of a linear actuator with a wiring conduit in an intermediate condition. Wiring conduit 802 may be placed in an intermediate condition as it transitions between a retracted condition and an extended condition. Third section 866 may have a bore size large enough to accommodate links 810 that have pivoted with respect to each other to an open position. The bore size in third section 866 may be too small to accommodate links 810 pivoted to a closed position with respect to each other. For example, the width of the bore in the direction of the y-axis may be smaller in third section 866 than in first section 862, although the width of the bore in the direction of the x-axis may remain constant across the different sections to accommodate the combined width (in the direction of the x-axis) of the C-shaped links 810 (as shown in the top view of FIG. 4). Further, second section 864 may taper between first section 862 and third section 866 in bore size.

Nut 804 may be coupled to a first end of wiring conduit 802 and may be moved along third section 866 of the housing 816. Movement of nut 804 away from first section 862 may pull adjacent links 810 apart thus causing adjacent links 810 to pivot to partially open positions with respect to each other. The taper of second section 864 may direct links 810 into third section 866 of housing 816 and may cause links 810 to further pivot to further open positions with respect to each other. A second end of the wiring conduit 802 may be anchored to pivot from a position that is radially outward relative to the bore of third section 866. Such an arrangement may cause wiring conduit 802 to have at least one link 810 that may be constrained to be aligned at least partially transverse to a central axis of the bore of third section 866.

Although the actuators described herein with reference to FIGS. 2A-2B and 8A-8B are described as linear actuators, some embodiments may utilize a non-linear actuator. For example, in some embodiments, a wiring conduit may include a curved shaft, or a shaft that has curved sections, and may be encompassed within a housing that is curved, or has curved sections. In such embodiments, the pivoting nature of the links may allow the series of links forming the wiring conduit to extend and retract across a curved, or partially curved, path.

Embodiments herein may include:

A. A downhole tool that includes an actuator including a housing, a shaft extending through at least a portion of the housing, and a nut movably disposed on the shaft. The downhole tool also includes a wiring conduit disposed in a helix shape around the shaft and extending between the nut and a fixed position relative to the shaft, the wiring conduit including a plurality of curved links, each of the plurality of curved links including a first hinge and a second hinge, the first hinge of a first curved link pivotably coupled to the second hinge of a second curved link. Further, the downhole tool includes a wire routed through the wiring conduit.

B. A wiring conduit including a plurality of curved links disposed in series in a helix shape, each of the plurality of curved links including a first hinge and a second hinge, the first hinge of a first curved link pivotably coupled to the second hinge of a second curved link.

Each of embodiments A and B may have one or more of the following additional elements in any combination:

Element 1: wherein the first curved link and the second curved link form a continuously curved path. Element 2: wherein each of the first hinge and the second hinge includes a channel through which the wire is routed. Element 3: wherein each of the plurality of curved links further comprises a wire guide located at an apex of the curved link, the wire guide including a wire-guide channel through which the wire is routed. Element 4: wherein the distance from an outer tip of the wire guide of the first curved link to the outer tip of the wire guide of the second curved link is approximately equal to an inner diameter of the housing. Element 5: wherein the housing includes a groove extending along an inner wall of the housing, and the wire guide further includes an alignment pin extending outward from the wire guide and into the groove of the housing. Element 6: wherein the actuator is a linear actuator and the housing extends along a linear path. Element 7: wherein the housing and the shaft each include a portion that extends along a curved path. Element 8: wherein the first hinge has a cylindrical shape with a smooth outer surface, and the second hinge has a cylindrical shape with a smooth inner surface. Element 9: wherein the first hinge of the first curved link has a cylindrical shape with a stopper protruding from a surface of the first hinge. Element 10: wherein the second hinge of the second curved link has a cylindrical shape with a ridge configured to engage the stopper of the first hinge of the first curved link to limit a maximum pivot angle of the first curved link and the second curved link. Element 11: wherein the section of housing through which the shaft extends has a continuous inner diameter. Element 12: wherein the housing has a first section with a first inner diameter, the housing has a second section with a second inner diameter, the housing has a third section located between the first section and the second section with an inner diameter that is tapered from the first inner diameter to the second inner diameter, and the shaft extends through at least a portion of each of the first, second, and third sections of the housing.

Although the present disclosure has been described with several embodiments, various changes and modifications may be suggested to one skilled in the art. It is intended that the present disclosure encompasses such various changes and modifications as falling within the scope of the appended claims.

What is claimed is:

1. A downhole tool, comprising:

an actuator comprising:

a housing;

a shaft extending through at least a portion of the housing; and a nut movably disposed on the shaft;

a wiring conduit disposed in a helix shape around the shaft and extending between the nut and a fixed position relative to the shaft, the wiring conduit comprising a plurality of curved links, each of the plurality of curved links including a first hinge and a second hinge, the first hinge of a first curved link pivotably coupled to the second hinge of a second curved link; and a wire routed through the wiring conduit.

2. The downhole tool of claim 1, wherein the first curved link and the second curved link form a continuously curved path.

3. The downhole tool of claim 1, wherein each of the first hinge and the second hinge includes a channel through which the wire is routed.

4. The downhole tool of claim 1, wherein each of the plurality of curved links further comprises a wire guide located at an apex of the curved link, the wire guide including a wire-guide channel through which the wire is routed.

5. The downhole tool of claim 4, wherein the distance from an outer tip of the wire guide of the first curved link to an outer tip of the wire guide of the second curved link is approximately equal to an inner diameter of the housing.

6. The downhole tool of claim 4, wherein:

the housing includes a groove extending along an inner wall of the housing; and the wire guide further includes an alignment pin extending outward from the wire guide and into the groove of the housing.

7. The downhole tool of claim 1, wherein the actuator is a linear actuator and the housing extends along a linear path.

8. The downhole tool of claim 1, wherein the housing and the shaft each include a portion that extends along a curved path.

9. The downhole tool of claim 1, wherein:

the first hinge has a cylindrical shape with a smooth outer surface; and the second hinge has a cylindrical shape with a smooth inner surface.

10. The downhole tool of claim 1, wherein the first hinge of the first curved link has a cylindrical shape with a stopper protruding from a surface of the first hinge.

11. The downhole tool of claim 10, wherein the second hinge of the second curved link has a cylindrical shape with a ridge configured to engage the stopper of the first hinge of the first curved link to limit a maximum pivot angle of the first curved link and the second curved link.

12. The downhole tool of claim 1, wherein the section of housing through which the shaft extends has a continuous inner diameter.

13. The downhole tool of claim 1, wherein:

the housing has a first section with a first inner diameter;

the housing has a second section with a second inner diameter;

the housing has a third section located between the first section and the second section with an inner diameter that is tapered from the first inner diameter to the second inner diameter; and the shaft extends through at least a portion of each of the first, second, and third sections of the housing.

14. A wiring conduit, comprising:

a plurality of curved links disposed in series in a helix shape, each of the plurality of curved links including a first hinge and a second hinge, the first hinge of a first curved link pivotably coupled to the second hinge of a second curved link;

wherein each of the plurality of curved links is continuously curved between the first hinge and the second hinge along a curved path of the helix shape; and wherein each of the first hinge and the second hinge includes a wiring conduit channel.

15. The wiring conduit of claim 14, wherein the first curved link and the second curved link form a continuously curved path.

16. The wiring conduit of claim 14, wherein each of the plurality of curved links further comprises a wire guide located at the apex of the curved link, the wire guide including a wire-guide channel.

17. The wiring conduit of claim 14, wherein:

the first hinge has a cylindrical shape with a smooth outer surface; and the second hinge has a cylindrical shape with a smooth inner surface.

18. The wiring conduit of claim 14, wherein the first hinge has a cylindrical shape with a stopper protruding from a surface of the first hinge.

19. The wiring conduit of claim 18, wherein the second hinge has a cylindrical shape with a ridge configured to engage the stopper of the first hinge to limit a maximum pivot angle of the first curved link and the second curved link.

* * * * *